US007142168B1

(12) United States Patent
Sinclair

(10) Patent No.: US 7,142,168 B1
(45) Date of Patent: Nov. 28, 2006

(54) APPARATUS FOR MOUNTING AND ADJUSTING A SATELLITE ANTENNA

(75) Inventor: Kevin D. Sinclair, Albion, MI (US)

(73) Assignee: Patriot Antenna Systems, Inc., Albion, MI (US)

( * ) Notice: Subject to any disclaimer, the term of this patent is extended or adjusted under 35 U.S.C. 154(b) by 0 days.

(21) Appl. No.: 11/010,042

(22) Filed: Dec. 10, 2004

Related U.S. Application Data

(60) Provisional application No. 60/615,036, filed on Oct. 1, 2004.

(51) Int. Cl.
*H01Q 3/08* (2006.01)

(52) U.S. Cl. ..... 343/882; 343/757; 343/878; 343/840; 343/890; 343/882; 343/765

(58) Field of Classification Search ..... 343/757, 343/878–882, 894, 760, 840, 890, 765, 880; 248/183, 185

See application file for complete search history.

(56) References Cited

U.S. PATENT DOCUMENTS 4,612,551 A 9/1986 Dreyer
4,628,323 A 12/1986 Crean
4,644,365 A * 2/1987 Horning ..... 343/882
4,689,635 A * 8/1987 Haupt ..... 343/894
4,726,259 A 2/1988 Idler
4,800,394 A 1/1989 Homann et al.
5,198,830 A 3/1993 Lin
5,469,182 A * 11/1995 Chaffee ..... 343/882
5,576,722 A 11/1996 Bustillos
5,734,356 A * 3/1998 Chang ..... 343/882
6,262,691 B1 7/2001 Austin et al.
6,342,870 B1 * 1/2002 Mehrkens et al. ..... 343/891
6,404,400 B1 6/2002 Tulloch
6,407,713 B1 * 6/2002 Mallenius ..... 343/765
6,445,361 B1 9/2002 Liu et al.
6,657,598 B1 * 12/2003 Tulloch ..... 343/765

* cited by examiner

*Primary Examiner*—Hoang V. Nguyen
*Assistant Examiner*—Chuc Tran
(74) *Attorney, Agent, or Firm*—Young Basile, P.C.

(57) ABSTRACT

An apparatus for mounting and adjusting a satellite antenna in the azimuth and elevational planes. The present invention provides a base having a longitudinal axis adaptable to adjustably receive a mounting pole. A rotational mount is rotatably connected to the base and has a longitudinal axis extending at an acute angle relative to the longitudinal axis of the base. A satellite antenna support is adaptable to receive a satellite antenna, and the satellite antenna support is adjustably coupled to the rotational mount for adjustment about a rotational axis wherein the rotational axis is substantially perpendicular to the longitudinal axis of the rotational mount. A first adjustment mechanism is coupled to the base and the rotational mount for providing fine azimuth adjustment of the satellite antenna. A second adjustment mechanism is coupled to the rotational mount and the satellite antenna support for \providing fine elevational adjustment of the satellite antenna.

20 Claims, 6 Drawing Sheets

APPARATUS FOR MOUNTING AND ADJUSTING A SATELLITE ANTENNA

The following patent application claims priority of provisional patent application Ser. No. 60/615,036 filed Oct. 1, 2004.

FIELD OF THE INVENTION

The present invention relates to satellite antennas, and more particularly, an apparatus for fine-tuning the adjustment of a satellite antenna in both the azimuth and elevational planes.

BACKGROUND OF THE INVENTION

The importance of accurately aligning a communication antenna relative to the associated signal source with which the antenna is positioned to communicate is well known. Such alignment is necessary for both land-based and satellite-based signal transmission systems. In either installation, it is important that the antenna be aligned along at least two axes. The first axis is that of the horizontal orientation of the antenna, or azimuth. The azimuth motion is typically directed to the points of the compass, i.e., north, east, south, west. The second axis of movement is that of the vertical orientation, or elevation. The elevation orientation moves up and down, that is, goes from the horizon to the zenith (directly overhead). Thus, it is well established that the ability to assemble, mount, and align a satellite antenna with the fewest manual adjustments and the most efficiency is a great advantage.

Ultimately, the precise alignment of a satellite antenna is a critical function. In order to facilitate alignment, electronic devices, such as those that measure the strength of the signal to the antenna, have been designed for use during the antenna installation. It is, however, necessary that the antenna be coarsely aligned with its designated signal source, such as a satellite, before such electronic devices that measure the strength of the signal to the antenna can be utilized. A coarse alignment of the antenna is thus necessary in order to first obtain a signal for subsequent dual axis tuning of the antennas in the azimuth and elevational orientations.

Once a coarse alignment of the satellite antenna is obtained, primary alignment or fine tuning of the satellite antenna occurs when the antenna is orientated and precisely positioned relative to a detected antenna signal strength. Although many designs have been created to aid in the primary adjustment of the satellite antenna, such designs are expensive, complex, cumbersome, and often difficult to use.

Typically, tuning of the satellite in the azimuth plane occurs with the azimuth plane lying in a direction substantially perpendicular to the axis of the base structure or mounting pole supporting the satellite antenna. Based on this structure, the azimuth adjustment range is reduced as the elevation angle increases to 90°. However, based on population demographics, the majority of satellite installations require an elevation range extending between 20–60° above the horizon. Thus, the azimuth adjustment range of the satellite antenna is not maximized by an azimuth plane perpendicular to the base or mounting pole of the satellite antenna.

Therefore, it would be desirable to provide a method and apparatus for mounting and adjusting a satellite antenna that was inexpensive, simple, quick, and accurate in detecting a strong signal. In addition, it would also be desirable to provide a method and apparatus for mounting and adjusting a satellite antenna that utilized a greater range of azimuth adjustment that corresponded to the largest population demographic.

SUMMARY OF THE INVENTION

The present invention relates to an apparatus for mounting and adjusting a satellite antenna along the azimuth and elevational planes. The present invention provides an adjustable base for providing coarse adjustment of the satellite antenna about the azimuth axis. A rotational mount is rotatably connected to the base and has a longitudinal axis extending at an acute angle relative to a longitudinal axis of the base. A satellite antenna support is adaptable to support a satellite antenna and is coupled to the rotational mount for rotating about an elevational axis for coarse adjustment of the satellite antenna about the elevational axis. A first adjustment mechanism is connected to the base and the rotational mount for providing a fine adjustment of the satellite antenna about the azimuth axis. A second adjustment mechanism is coupled to the rotational mount and the satellite antenna support for providing a fine adjustment of the satellite antenna about the elevational axis.

BRIEF DESCRIPTION OF THE DRAWINGS

The description herein makes reference to the accompanying drawings wherein like referenced numerals refer to like parts throughout several views and wherein.

DESCRIPTION OF THE PREFERRED EMBODIMENT

Figure 1:
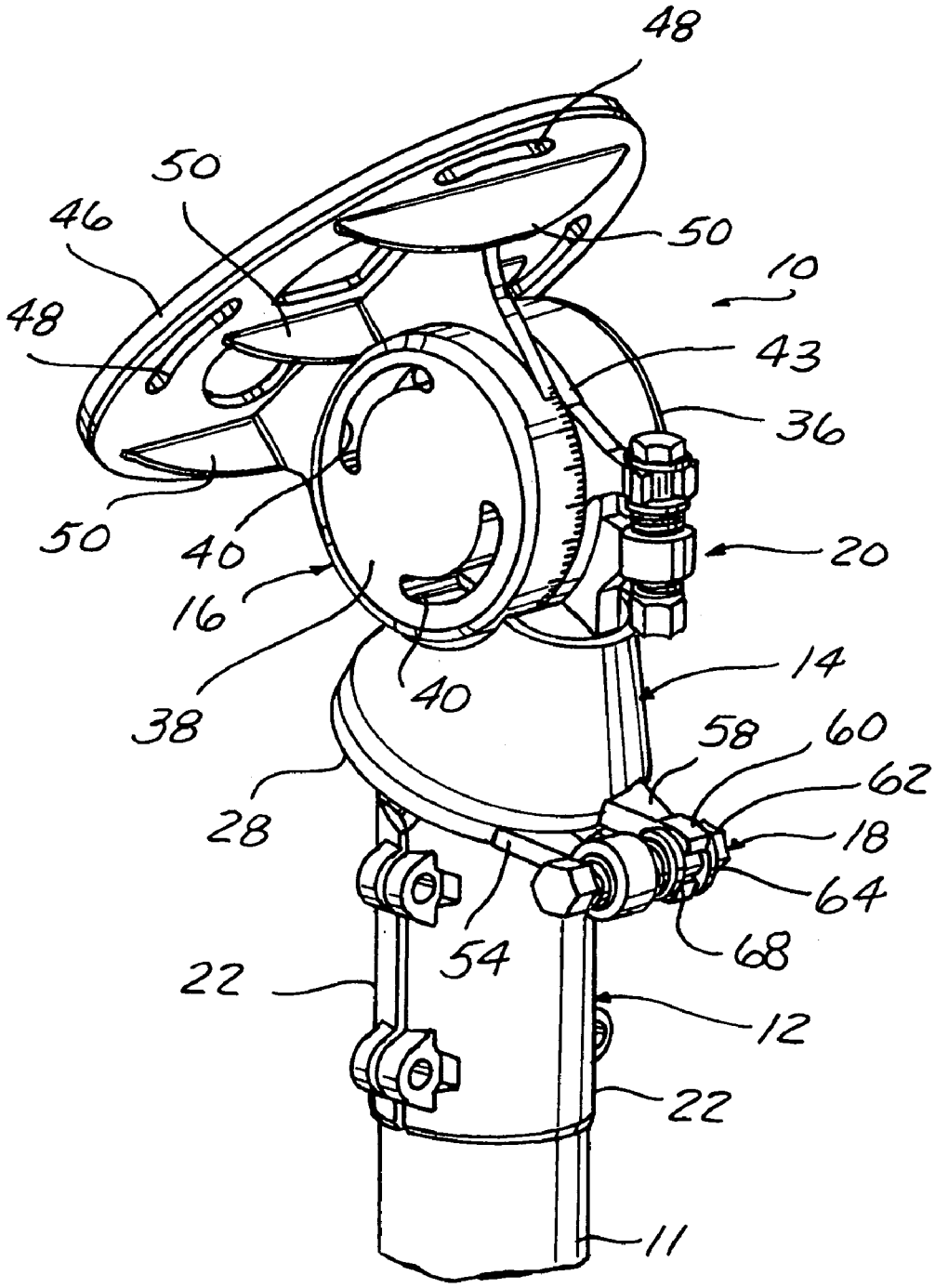
FIG. 1 is a perspective view of the satellite antenna mount of the present invention.
Figure 2:
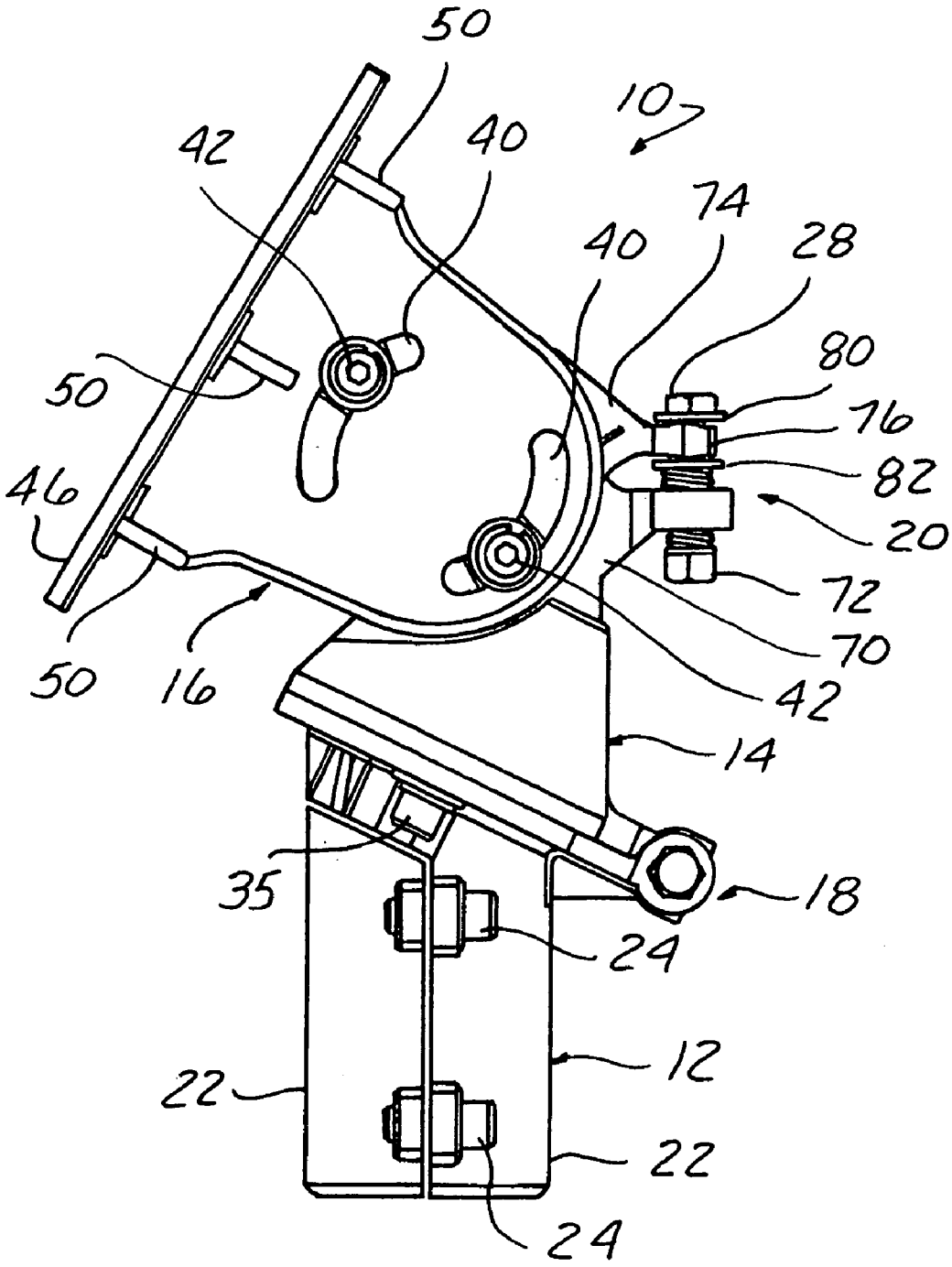
FIG. 2 is a plan side view of the satellite antenna mount of the present invention.
Figure 3:
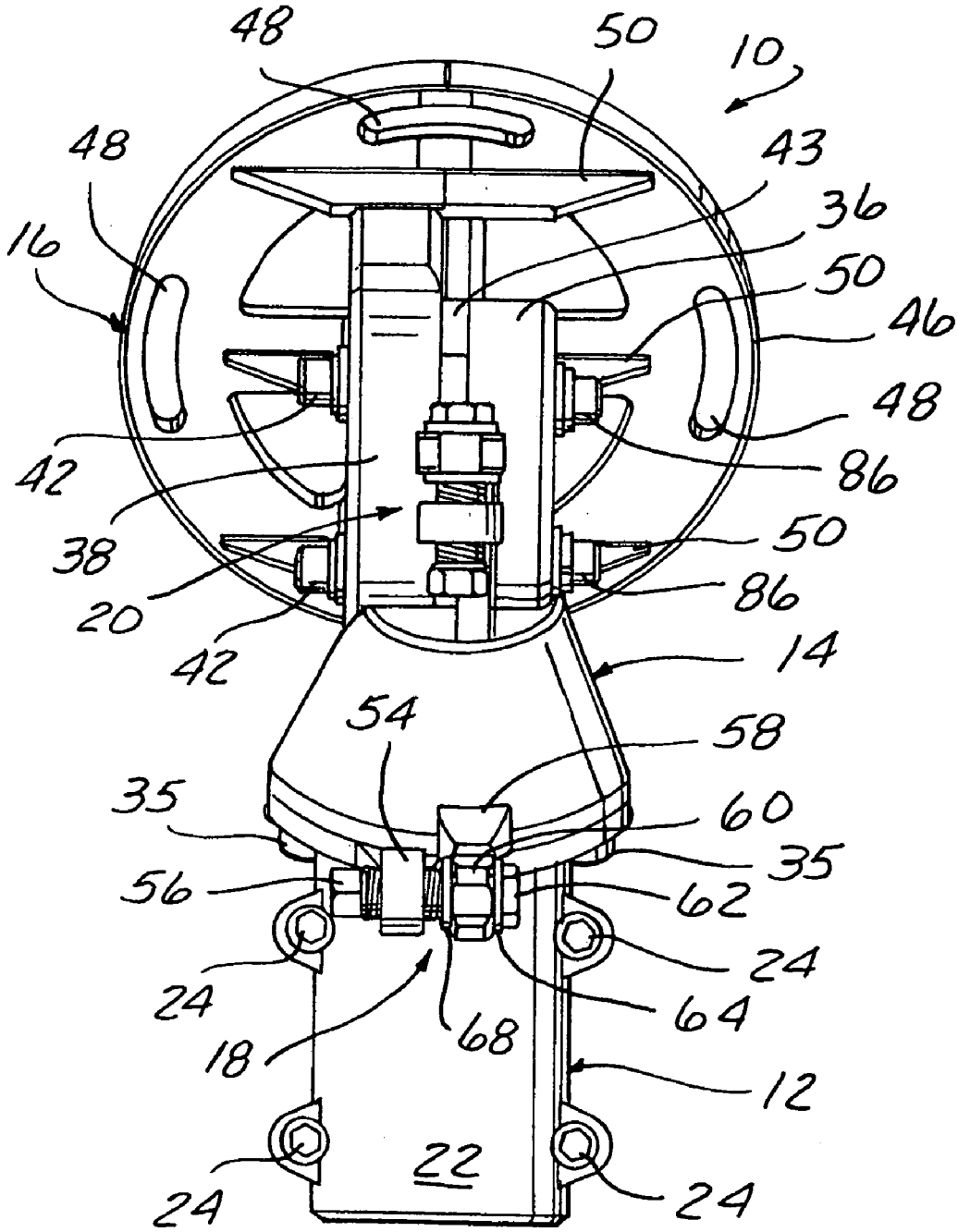
FIG. 3 is a plan rear view of the satellite antenna mount of the present invention.
Figure 4:
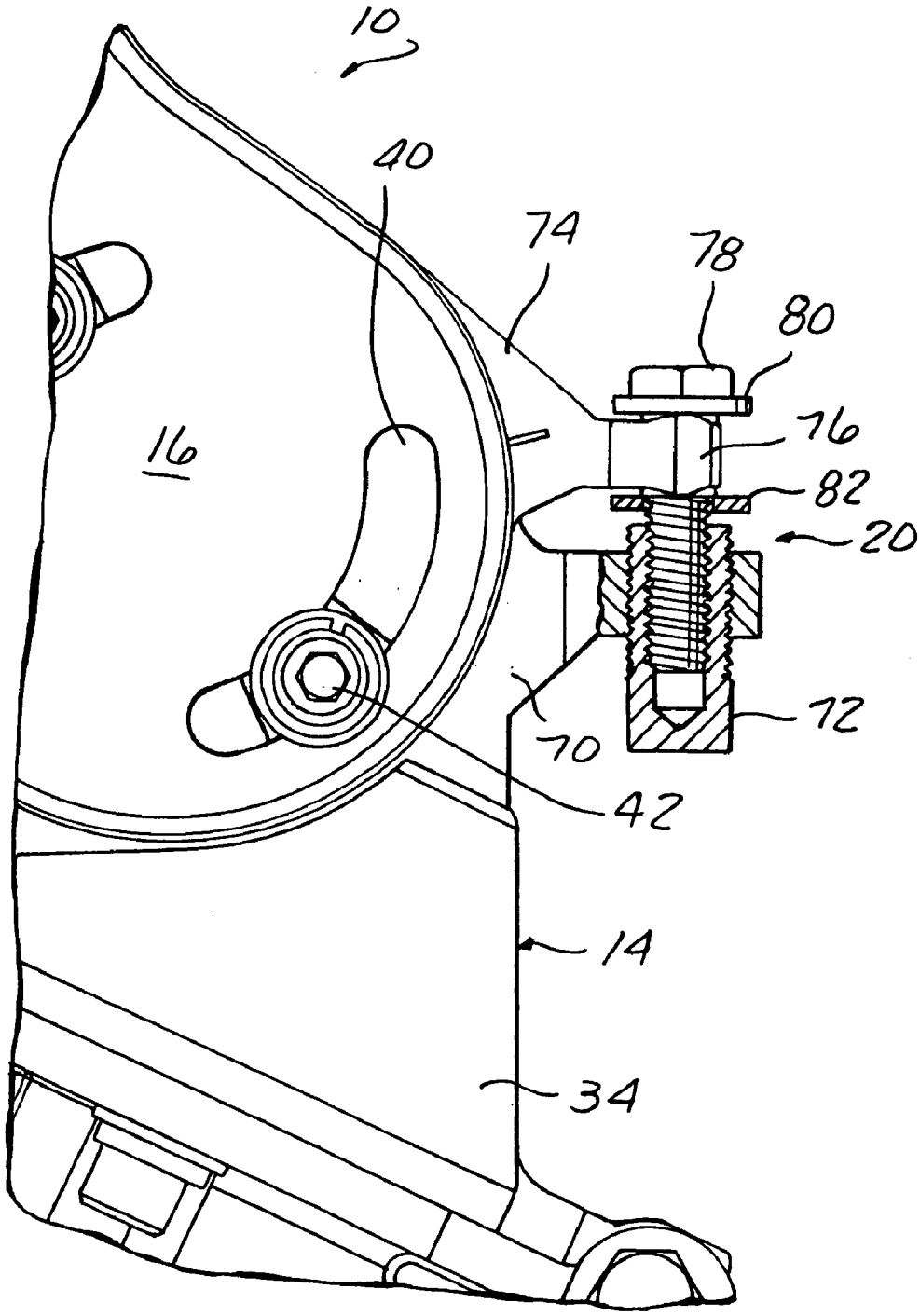
FIG. 4 is a sectional view of the elevational fine tuning adjustment mechanism of the satellite antenna mount of the present invention.
Figure 5:
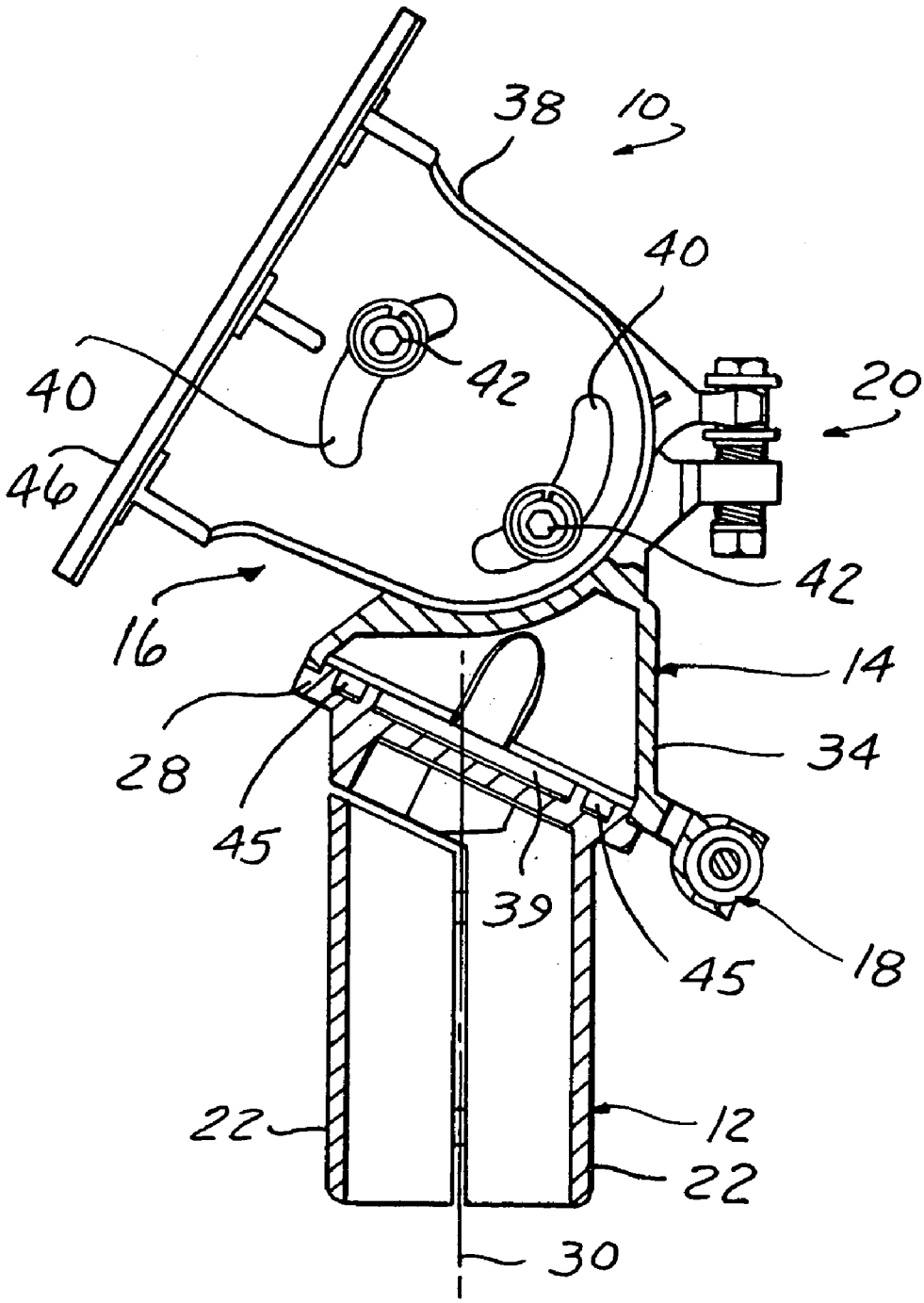
FIG. 5 is a sectional view of the azimuth fine tuning adjustment mechanism of the satellite antenna mount of the present invention.

Referring to the drawings, the present invention will now be described in detail with reference to the disclosed embodiment.

As illustrated in FIGS. 1–6, the present invention provides an apparatus 10 for mounting and adjusting a satellite antenna (not shown) about an elevational axis and an azimuth axis. The apparatus 10 of the present invention provides an adjustable base 12 releasably connected to a fixed mounting pole 11 which is secured in the ground or a mounting structure (not shown). A rotational mount 14 is rotatably connected to the base 12 and provides for adjustment of the satellite antenna in the azimuth plane. The rotational mount 14 is adjustably connected to an elevational fine-tuning adjustment mechanism 18 which in turn is connected to a satellite antenna support 16. The satellite antenna support 16 is adaptable to connect to and support the satellite antenna. The satellite antenna support 16 adjustably rotates with respect to the elevational fine tuning adjustment mechanism 18 thereby providing both coarse and fine adjustment to the satellite antenna in the elevational plane. The elevational fine-tuning adjustment mechanism 18 and an azimuth fine-tuning adjustment mechanism 20 provide fine adjustment about both the elevational axis and the azimuth axis, respectively. Thus, the apparatus 10 of the present invention provides a method for fine-tuning the adjustment of the satellite antenna in both the azimuth and elevational planes.

To provide a coarse adjustment of the satellite antenna about the azimuth axis, the base 12 of the present invention provides two substantially similar semi-circular cylindrical halves 22 that are connected by four fasteners 24 to form the substantially cylindrical base 12. The cylindrical base 12 receives the fixed mounting pole 11, and by loosening the four fasteners 24, the cylindrical base 12 may rotate to provide a coarse alignment of the satellite antenna about the azimuth axis. The four fasteners 24 are simply tightened to maintain the position of the base 12 relative to the mounting pole 11. An upper end 28 of the base 12 lies in a plane or azimuth plane that extends at an acute angle relative to a longitudinal axis 30 of the base 12. Normally, the azimuth plane is horizontal, however, based on population demographics, the majority of the satellite antenna installations will be set at an elevation range between a twenty to sixty degree angle above the horizontal plane. Therefore, the acute angle may be set anywhere between twenty and sixty degrees above the horizon in order to provide a greater range of adjustment about the azimuth axis. The inventor has chosen to set the acute angle at twenty-five degrees.

In order to provide a fine or primary adjustment of the satellite antenna about the azimuth axis, the rotational mount 14 has a frusto-conical shaped portion 34 wherein the larger diameter end of the frusto-conical shaped portion 34 provides an end surface 37 that matingly engages the upper end 28 of the base 12. The rotational mount 14 is attached to the base 12 through the use of a pair of threaded fasteners 35 which extend upward through the base 12 and into the frusto-conical shaped portion 34 of the rotational mount 14. The smaller diameter end of the frusto-conical shaped portion 34 is connected to a substantially circular portion 36 of the rotational mount 14. The circular portion 36 is connected to and integral with the frusto-conical portion 34 of the rotational mount 14.

The mating engagement of the rotational mount 14 relative to the base 12 occurs through the upper end 28 of the base 12 having an internal, substantially cylindrical portion 31 coaxial to the outer periphery of the base 12 and two internal opposing arcuate slots 33 coaxial with the cylindrical portion 31 and the outer periphery of the base 12. The end surface 37 of the rotational mount 14 rotatably engages the upper end 28 of the base 12 by having a substantially cylindrical portion 39 that is matingly received by the cylindrical portion 31 of the upper end 28 of the base 12. A pair of protrusions 45 extend from the rotational mount 14 to engage the arcuate slots 40 in the upper end 28 of the base 12 such that the rotational mount 14 may rotate with respect to the base 12 when the fasteners 35 are disengaged from the rotational mount 14. The azimuth fine-tuning adjustment mechanism 18 is connected to both the base 12 and the rotational mount 14 and provides for a fine-tuning adjustment about the azimuth axis. The azimuth fine-tuning adjustment mechanism 18 will be described in detail later in the specification.

Figure 6:
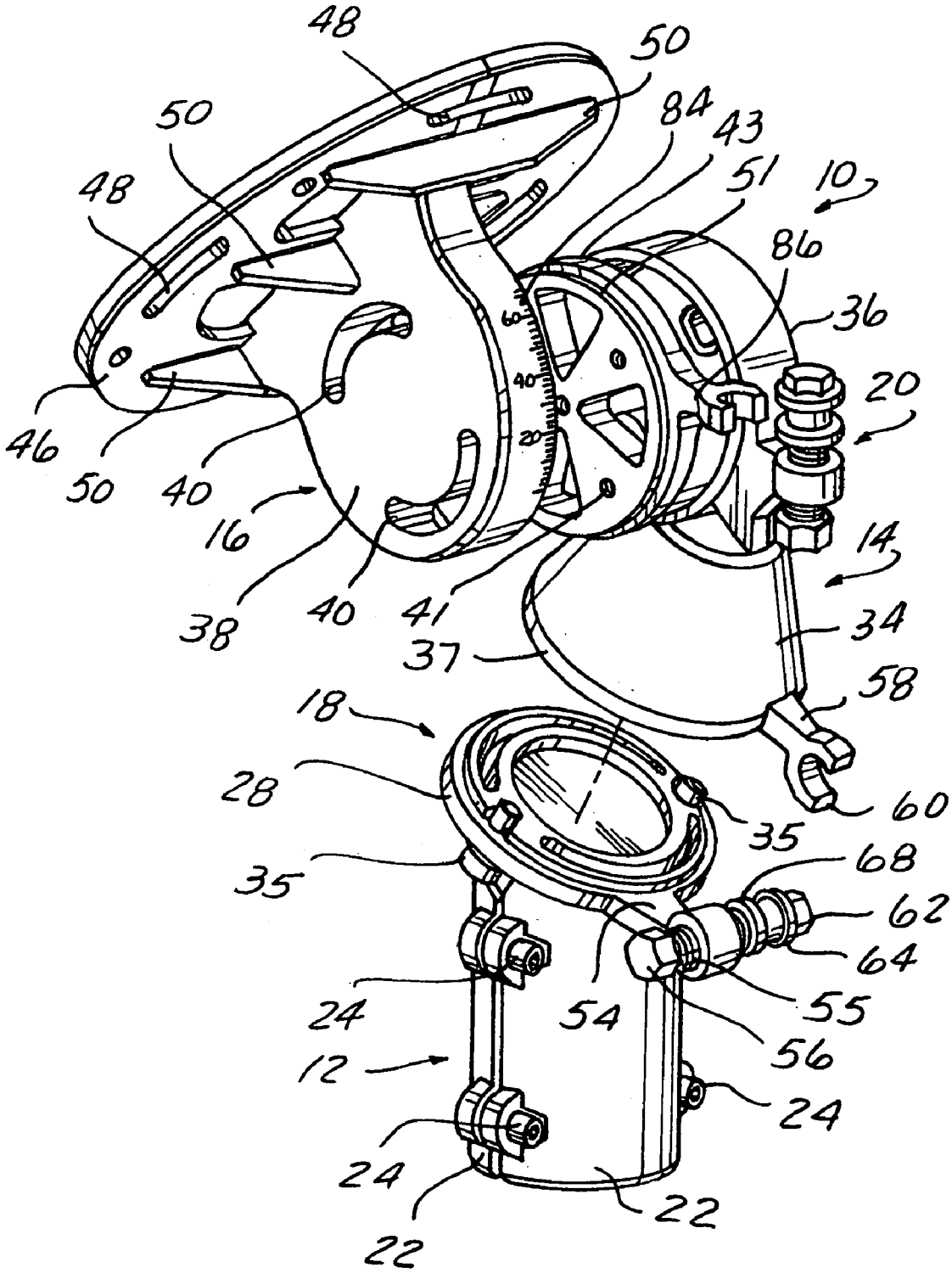
FIG. 6 is an exploded view of the satellite antenna mount of the present invention.

To provide a primary or coarse adjustment about the elevational axis, the satellite antenna support 16 is adjustably connected to the elevational fine-tuning adjustment mechanism 20. The satellite antenna support 16 provides a substantially U-shaped portion 38 having a pair of opposing and coaxial arcuate slots 40 formed therein and extending therethrough. FIGS. 1 and 6 show two possible embodiments of the U-shaped portion 38. A pair of threaded fasteners 42 extend through the arcuate slots 40 of the U-shaped portion 38 of the satellite antenna support 16 and are threadedly received by threaded apertures 41 provided in a substantially circular spoked wheel 43 of the elevational fine-tuning adjustment mechanism 20. When the fasteners 42 are loosened, the satellite antenna support 16 is allowed to rotate on a bearing surface 51 of the spoked wheel 43 of the elevational fine-tuning mechanism 20 while having the fasteners 42 travel along the arcuate slots 40 provided in the U-shaped portion 38 of the satellite antenna support 16. The rotation of the satellite antenna support 16 allows for coarse adjustment of the satellite antenna about a rotational axis known as the elevational axis. The spoked wheel 43 of the elevational fine-tuning adjustment mechanism 20 is sandwiched between and connected to the U-shaped portion 38 of the satellite antenna support 16 and the circular portion 36 of the rotational mount 14. The spoked wheel 43 of the elevational fine tuning adjustment mechanism 20 will be described in detail later in the specification.

To support the satellite antenna, a substantially circular disc-shaped plate 46 is integrally connected to the U-shaped portion 38 of the satellite antenna support 16. Structural ribs 50 extend from the U-shaped portion 38 of the satellite antenna support 16 to the disc-shaped plate 46 to provide additional support to the satellite antenna. The plate-like disc 46 has arcuate slots 48 extending therethrough for receiving fasteners (not shown) that connect the satellite antenna to the satellite antenna support 16.

In order to fine-tune the satellite antenna about the azimuth and elevational axes, the azimuth and elevational fine-tuning adjustment mechanism 18, 20, respectively, each provide a similar structure. The azimuth fine-tuning adjustment mechanism 18 has a first bracket 54 that is integral with and extends outward from the upper end 28 of the base 12. The first bracket 54 provides a threaded aperture 55 for receiving a threaded bolt 56. However, the bolt 56 is unique in that it provides a threaded outer periphery and a blind threaded bore therein. A second bracket 58 of the azimuth fine-tuning adjustment mechanism 18 is integrally connected to the larger diameter of the frusto-conical portion 34 of the rotational mount 14. The second bracket 58 has a substantially C-shaped portion 60 for receiving a threaded bolt 62. A pair of washers 64, 68 are fixedly mounted to the bolt 62 on opposite sides of the C-shaped bracket 60. The threaded end of the bolt 62 is threadably received by the threaded blind bore of bolt 56, however, the thread pitch ratio of the threads on bolt 56 and the aperture 55 as compared to bolt 62 and the blind bore of bolt 56 is 2:1, so that with each revolution of bolts 56, 62, the bolt 56 travels half the linear distance as bolt 62.

The elevational fine-tuning adjustment mechanism 20 is similar to the azimuth fine-tuning adjustment mechanism 18 in that it provides a first bracket 70 integrally connected to the circular portion 36 of the rotational mount 14. The first bracket 70 provides a threaded aperture for receiving a threaded bolt 72. The bolt 72 is unique in that it provides a threaded outer periphery and a threaded blind bore therein. A second bracket 74 of the elevational fine-tuning adjustment mechanism 20 is integrally connected to the spoked wheel 43 of the elevational fine-tuning adjustment mechanism 20. The second bracket 74 has a C-shaped bracket 76 for receiving a threaded bolt 78. The bolt 78 has a pair of washers 80, 82 fixedly mounted to the bolt 78 on opposite sides of the C-shaped bracket 76. The threaded bolt 78 is threadably received by the threaded blind bore of bolt 72. The threaded aperture of the first bracket 70 and the threaded outer periphery of the bolt 72 have a thread pitch ratio of 2:1 with respect to the threads in the internal bore of bolt 72 and the threaded outer periphery of bolt 78. Thus, with each revolution of bolt 72 and bolt 78, bolt 72 will travel half the linear distance of bolt 78.

In use, a coarse adjustment about the azimuth axis is provided by loosening the fasteners 24 on the base 12 and allowing the base 12 to rotate about the mounting pole 11. Once a satisfactory signal is received or a proper position located, the fasteners 24 of the base 12 are tightened to fix the base 12 relative to the mounting pole 11.

A coarse adjustment about the elevational axis is then provided by loosening, the fasteners 42 in the arcuate slots 40 of the satellite antenna support 16 so that the satellite antenna support 16 and the satellite antenna may rotate relative to the elevational fine-tuning adjustment mechanism 20 about the elevational axis. When the desired elevational angle is obtained, the fasteners 42 are tightened so as to maintain the elevational angle of the satellite antenna support 16 and the satellite antenna. An indicia 84 is provided on the satellite antenna support 16 such that the user can record the position of the satellite antenna support 16. A marker 86 on the spoked wheel 43 of the elevational fine-tuning adjustment mechanism 20 provides a reference point to the indicia 84 as to the position of the satellite antenna support 16.

Fine adjustment of the satellite antenna about the azimuth axis is then provided by rotating the head of bolt 62 of the azimuth fine-tuning adjustment mechanism 18 clockwise approximately one to two turns so that the satellite antenna points away from the primary initial setting. The bolt 62 is turned until the signal being received by the satellite antenna drops below a desired power level reference point. Both bolt 56 and bolt 62 are tied to each other at this point, and therefore, both bolts 56, 62 turn together as a unit. The power level drop is measured and recorded through an electronic measuring device (not shown). While holding the fine-threaded bolt 56 from turning, the coarser threaded bolt 62 is turned counter-clockwise approximately one to two turns. This will move the satellite antenna in the opposite direction toward and through the strongest power level reading. Bolt 62 is then turned until the exact power drop reading, as in the first step, is obtained. When this occurs, a gap will occur between washer 68 and the threaded end of bolt 56. Bolt 62 is then held stationary while bolt 56 is tightened until the end of bolt 56 abuts washer 68. By having the thread pitch of bolt 56 be half that of the thread pitch of bolt 62, bolt 56 travels only half the linear distance as bolt 62 with the same amount of rotation. Therefore, when bolt 56 is rotated, the satellite antenna rotates half the distance of its previous position, therefore putting the satellite antenna exactly mid-way between the two power drops of the satellite signal. This ensures that the satellite antenna is in a position to receive the strongest possible power signal from the satellite.

Fine adjustment about the elevational axis occurs through the exact same method as described in the azimuth fine-tuning adjustment mechanism 18, however, the elevational fine-tuning adjustment mechanism 20 is utilized as opposed to the azimuth fine-tuning mechanism 18. Before fine tuning the satellite antenna about the elevational axis, fasteners 86 connecting the circular portion of the rotational mount 14 to the spoked wheel 43 of the elevational fine-tuning adjustment mechanism 20 must be removed from the spoked wheel 43 to allow rotation of the spoked wheel 43 relative to the rotational mount 14. Bolts 72, 78 are adjusted in the same fashion as bolts 56, 62, as previously described, in order to obtain the strongest possible signal to the satellite antenna. Once the fine-tuning adjustment is made, the fasteners 86 are threaded back into the rotational mount 14 to connect the spoked wheel 43 to the rotational mount 14 and prevent the set elevational position from changing. Once the fine adjustment is completed about the azimuth and elevational axes, the satellite antenna is in its optimum position.

While the invention has been described in connection with what is presently considered to be the most practical and preferred embodiment, it is to be understood that the invention is not to be limited to the disclosed embodiments, but to the contrary, it is intended to cover various modifications or equivalent arrangements included within the spirit and scope of the appended claims. The scope is to be accorded the broadest interpretation so as to encompass all such modifications and equivalent structures as is performed under the law.

What is claimed is:

1. An apparatus for mounting and adjusting a satellite antenna, comprising:

an adjustable base for providing coarse adjustment of the satellite antenna about an azimuth axis;

a rotational mount rotatably connected to said base;

a satellite antenna support adaptable to support a satellite antenna and coupled to said rotational mount for rotation about an elevational axis for coarse adjustment of the satellite antenna about said elevational axis;

a first adjustment mechanism connected to said base and said rotational mount for providing a fine adjustment of the satellite antenna about said azimuth axis; and a second adjustment mechanism coupled to said rotational mount and said satellite antenna support for providing fine adjustment of the satellite antenna about said elevational axis.

2. The apparatus stated in claim 1, further comprising:

said base having a longitudinal axis, and said base adjustably connectable to a mounting pole for rotatably adjusting said base about said longitudinal axis.

3. The apparatus stated in claim 2, further comprising:

said rotational mount having a longitudinal axis extending at an acute angle relative to said longitudinal axis of said base.

4. The apparatus stated in claim 1, wherein said first adjustment mechanism further comprises:

a first bracket connected to said base and having a threaded aperture formed therein;

a second bracket connected to said rotational mount;

a first threaded fastener having a threaded blind bore formed therein and a threaded outer periphery wherein said threaded outer periphery is threadably received by said threaded aperture in said first bracket; and a second threaded fastener received by said second bracket and threadably received by said threaded blind bore in said first threaded fastener.

5. The apparatus stated in claim 4, further comprising:

said first threaded fastener having a thread pitch ratio of said threaded blind bore to said threaded outer periphery of 2:1.

6. The apparatus stated in claim 1, wherein said second adjustable mechanism further comprises:

a first bracket connected to said rotational mount and having a threaded aperture formed therein;

a second bracket releasably connected to said rotational mount and said satellite antenna support;

a first threaded fastener having a threaded blind bore formed therein and a threaded outer periphery wherein said threaded outer periphery is threadably received by said threaded aperture in said first bracket; and a second threaded fastener received by said second bracket and threadably received by said threaded blind bore in said first threaded fastener.

7. The apparatus stated in claim 6, further comprising:

said first threaded fastener having a thread pitch ratio of said threaded blind bore to said threaded outer periphery of 2:1.

8. An apparatus for mounting and adjusting a satellite antenna, comprising:

an adjustable base having a longitudinal axis and adaptable to adjustably receive a mounting pole about said longitudinal axis to provide a coarse adjustment of the satellite antenna about an azimuth axis;

a rotational mount rotatably connected to said base, and said rotational mount having a longitudinal axis extending at an acute angle relative to said longitudinal axis of said base;

a first adjustment mechanism connected to said base and said rotational mount for rotatably adjusting said rotational mount about said longitudinal axis of said rotational mount to provide fine adjustment of said satellite antenna about said azimuth axis;

a second adjustment mechanism connected to said rotational mount;

a satellite antenna support adaptable to support the satellite antenna and adjustably connected to said second adjustment mechanism for rotation of said satellite antenna support about an elevational axis to provide a coarse and a fine adjustment of said satellite antenna about said elevational axis.

9. The apparatus stated in claim 8, further comprising:

said acute angle between said longitudinal axis of said base and said longitudinal axis of said rotational mount extending between twenty to sixty degrees.

10. The apparatus stated in claim 8, wherein said first adjustment mechanism further comprises:

a first bracket connected to and extending from said base, and said first bracket having a threaded aperture formed therein;

a second bracket connected to and extending from said rotational mount;

a first threaded fastener having a threaded blind bore formed therein and a threaded outer periphery, wherein said threaded outer periphery is threadably received by said threaded aperture in said first bracket; and a second threaded fastener received by said second bracket and threadably received by said threaded blind bore in said first threaded fastener.

11. The apparatus stated in claim 10, further comprising:

said first threaded fastener having a thread pitch ratio of said threaded blind bore to said outer periphery of 2:1.

12. The apparatus stated in claim 8, wherein said second adjustment mechanism further comprises:

a first bracket connected to and extending from said rotational mount and having a threaded aperture formed therein;

a second bracket releasably connected to said rotational mount and said satellite antenna support;

a first threaded fastener having a threaded blind bore formed therein and a threaded outer periphery wherein said threaded outer periphery of said first threaded fastener is threadably received by said threaded aperture in said first bracket; and a second threaded fastener received by said second bracket and threadably received by said threaded blind bore in said first threaded fastener.

13. The apparatus stated in claim 12, further comprising:

said first threaded fastener having a thread pitch ratio of said threaded blind bore to said threaded outer periphery of 2:1.

14. The apparatus stated in claim 8, further comprising:

said satellite antenna support having indicia formed thereon; and said second adjustment mechanism having a reference marker to indicate the elevational position of said satellite antenna relative to said indicia.

15. A method for mounting and adjusting a satellite antenna, comprising:

providing a base adjustably connected to a rotational mount, coupled to a satellite antenna support, which is adapted to support a satellite antenna;

rotating said base about a longitudinal axis of said base to provide a coarse adjustment of said satellite antenna about an azimuth axis;

mounting said rotational mount such that a longitudinal axis of said rotational mount is at an acute angle with respect to said longitudinal axis of said base;

rotating said rotational mount in a first direction until the satellite antenna receives a predetermined drop in a power signal, and then rotating said rotational mount in an opposite direction until said predetermined drop in said power signal is again realized by said satellite antenna, and then rotating said rotational mount in the first direction halfway between the two power drop locations, thereby providing a fine adjustment of the satellite antenna about the azimuth axis;

rotating said satellite antenna support relative to said rotational mount about an elevational axis to provide a coarse adjustment of said satellite antenna about said elevational axis; and rotating said satellite antenna support in a first direction until the satellite antenna receives a predetermined drop in the power signal, and then rotating said satellite antenna support in an opposite direction until said predetermined drop in the power signal is again realized, and then rotating said satellite antenna support in the first direction halfway between the two power drop locations, thereby providing a fine adjustment of the satellite antenna about the elevational axis.

16. The method stated in claim 15, further comprising the steps of:

adjustably mounting said base to a mounting pole.

17. The method stated in claim 15, further comprising the steps of:

mounting said rotational mount to said base such that said acute angle is between twenty to sixty degrees.

18. The method stated in claim 15, further comprising the steps of:

utilizing a pair of threadedly mating fasteners having a thread pitch ratio of 2:1 to rotatably adjust the rotational mount so that when the rotational mount is rotatably adjusted between predetermined power drop locations, the threaded fasteners may be turned to a substantially mid-way point between power drop locations to provide the strongest signal about the azimuth axis.

19. The method stated in claim 15, further comprising the steps of:

utilizing a pair of matingly threaded fasteners having a thread pitch ratio of 2:1 to rotatably adjust the satellite antenna support so that when the satellite antenna support is rotatably adjusted between predetermined power drop locations, the threaded fastener may be turned to a substantially mid-way point between power drop locations to provide the strongest signal about the elevational axis.

20. The method stated in claim 15, further comprising the steps of:

providing indicia on said satellite antenna support for indicating the position about said elevational axis of said satellite antenna after coarse and fine adjustments are made.

* * * * *